United States Patent [19]

Scharl

[11] Patent Number: 4,571,569

[45] Date of Patent: Feb. 18, 1986

[54] MOUNTING FOR AN ESPECIALLY CURRENT-COMPENSATED, FERRITE RING-CORE CHOKE

[75] Inventor: Werner Scharl, Regensburg, Fed. Rep. of Germany

[73] Assignee: Siemens Aktiengesellschaft, Berlin and Munich, Fed. Rep. of Germany

[21] Appl. No.: 643,890

[22] Filed: Aug. 24, 1984

[30] Foreign Application Priority Data

Aug. 26, 1983 [DE] Fed. Rep. of Germany ..... 3330881

[51] Int. Cl.[4] ..... H01F 15/02; H01F 27/26

[52] U.S. Cl. ..... 336/65; 336/229

[58] Field of Search ..... 336/65, 229, 233, 92

[56] References Cited

U.S. PATENT DOCUMENTS 3,526,712 9/1970 Drom ..... 336/65 X 4,263,479 4/1981 Lange et al. ..... 336/92 X

FOREIGN PATENT DOCUMENTS 3047603 7/1982 Fed. Rep. of Germany ..... 336/65

*Primary Examiner*—Thomas J. Kozma

*Attorney, Agent, or Firm*—Herbert L. Lerner; Laurence A. Greenberg

[57] ABSTRACT

A mounting for an especially current-compensated ferrite ring core choke, includes an insulating material plate, and a potential-isolating device, the potential-isolating device including straps fastened upright on the insulating material plate, and a resilient ring interconnecting the straps, the straps having inner edges facing each other and outer edges, the ferrite ring core choke being slipped on the potential-isolating device with the outer edges of the straps resting resiliently against the ferrite ring core and windings on different sections of the ring core physically separated from each other.

7 Claims, 3 Drawing Figures

MOUNTING FOR AN ESPECIALLY CURRENT-COMPENSATED, FERRITE RING-CORE CHOKE

The invention relates to a mounting for an especially current-compensated ring-core choke with an insulating material plate and a potential-isolating device fastened to the insulating material plate, the ferrite ring-core choke being slipped onto the plate in such a manner that windings placed on different ring core sections of the choke are physically separated from each other.

A multiplicity of potential-isolating devices for chokes of the above-mentioned type are known. Thus, for instance, German Published, Non-Prosecuted Application No. DE-OS 30 47 603 describes a small plate formed of insulating material which can be inserted into the opening of the ferrite ring core. The plate is made resilient by means of slot-like breakthroughs extending transversely to the insertion opening of the ferrite ring core, in such a manner that the inserted insulating material plates rest resiliently against the ferrite ring core with the corresponding front edges thereof.

However, this and other conventional potential-isolating devices have considerable disadvantages. For example, they are not resilient enough to compensate for the tolerances of the residual holes of the wound ferrite ring cores. In other cases, the potential-isolating devices are not adapted to the inner diameter of the ferrite ring cores over the entire height thereof, or their shape is such that they are forcibly bent during insertion into the ring core hole and thus become so thin that they do not ensure the required spacings between the windings which, for instance, are $\geqq 2.4$ mm for CSA.

It is accordingly an object of the invention to provide a mounting for an especially current-compensated, ferrite ring-core choke, which overcomes the hereinaforementioned disadvantages of the heretofore-known devices of this general type, and which is equipped with a potential-isolating device that avoids the disadvantages pointed out above. In particular, the mounting should also compensate for large tolerances of the inner hole diameters of ferrite ring cores, and specifically without subjecting the ferrite ring cores to high mechanical stresses. Nevertheless, this potential-isolating device is to rest against the wall of the hole of the ferrite ring cores with firm pressure and is to ensure safe maintenance of the spacings between the windings required by testing authorities.

With the foregoing and other objects in view there is provided, in accordance with the invention, a mounting for an especially current-compensated ferrite ring core choke, comprising an insulating material plate, and a potential-isolating device, the potential-isolating device including straps fastened upright on the insulating material plate, and a resilient ring interconnecting the straps, the straps having inner front edges facing each other and outer front edges, the ferrite ring core choke being slipped on the potential-isolating device with the outer edges of the straps resting resiliently against the ferrite ring core and windings of the choke on different sections of the ring core physically separated from each other.

In accordance with another feature of the invention, the insulating material plate has cutouts formed therein defining resilient bracket elements between the cutouts, the straps being connected to the resilient bracket elements. This gives the straps their excellent spring properties.

An appropriate choice of the width of the straps, which are customarily constructed as slabs, ensures that the required distances between the windings will be maintained. Appropriate matching of the spring forces of the resilient bracket elements to the elastic or resilient ring, secures contact of the potential-isolating device against the wall of the ring core hole.

In accordance with a further feature of the invention, the insulating material plate, the straps and the ring are integral with each other.

In accordance with an added feature of the invention, the straps are in the form of two co-planar straps interconnected by the resilient ring.

In accordance with the additional feature of the invention, the straps are in the form of at least three straps aligned equidistant from the longitudinal central axis of the potential-isolating device, the straps having inner edges being interconnected by the resilient ring.

In the case of several windings to be insulated from each other by a potential-isolating device, it is advisable to use a common potential-isolating device with three or more straps, if required, which are aligned equidistant from the longitudinal central axis of the potential-isolating device. The straps are again connected to each other by a common resilient ring fastened to their inner edges.

In accordance with again another feature of the invention, the outer edges of the straps define the outer periphery of the potential-isolating device and rest resiliently against opposite surfaces defining a hole formed in the ferrite ring core. If it is impossible to provide resilient bracket elements for the insulating material plate, it is advisable to match the outer circumference of the potential-isolating device determined by the outer edges to the inner hole diameter of the ferrite ring core, so that the straps are already forced to rest resiliently against the surfaces of the ferrite ring core that face each other, due to the spring properties of the ring.

In accordance with a concomitant feature of the invention, the straps have end surfaces facing away from the insulating material plate, and one of the straps is wider than the other of the straps at least at the end surface thereof, for positioning the windings relative to the ferrite ring core. This makes it possible to identify the position of the windings unambiguously, especially in the case of a ferrite ring core choke covered by an insulating material cap.

Other features which are considered as characteristic for the invention are set forth in the appended claims. Although the invention is illustrated and described herein as embodied in a mounting for an especially current-compensated, ferrite ring-core choke, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments with read in connection with the accompanying drawings, in which:

FIG. 2 is a cross-sectional view taken along the line II-II in FIG. 1, with the ring core choke slipped on.

Figure 1:
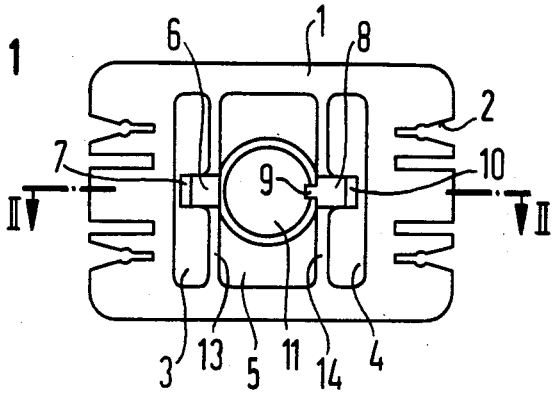
FIG. 1 is a diagrammatic top-plan view of a mounting with a potential-isolating device according to the invention, before the ring core choke is installed.
Figure 2:
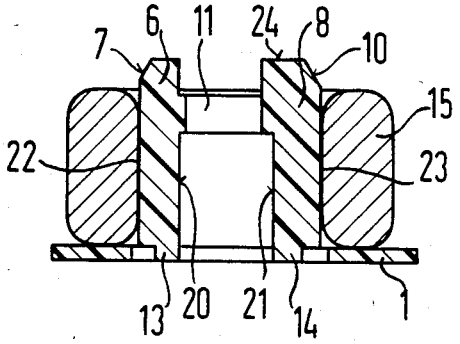
Figure 3:
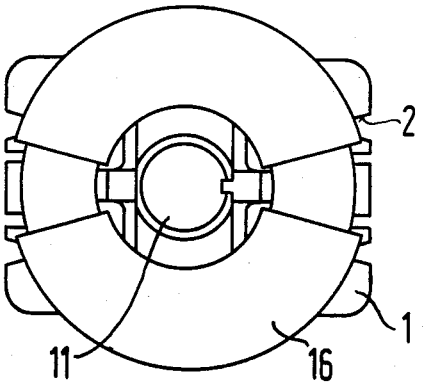
FIG. 3 is a top-plan view of a ferrite ring core choke which is covered by an insulating cap and is slipped on a mounting according to FIGS. 1 and 2.

Referring now to FIGS. 1-3 of the drawings in detail as a whole, it is seen that the mounting has an insulating material plate 1 with clamping slots 2 formed therein for the ends of the windings. The insulating material plate 1 has cutouts 3, 4, 5 formed therein, providing resilient bracket elements 13, 14 between the cutouts. Straps 6, 8 are mounted on the bracket elements 13, 14 as partial elements of the potential-isolation device. The straps 6, 8 are connected to each other by an elastic or resilient ring 11. Edges 20, 21 of the straps 6, 8 face each other and outer edges 22, 23 of the straps rest against a ferrite ring core choke 15 which is slipped on the potential-isolating device, to FIG. 2. The plate, straps and ring may be integral with each other. According to FIG. 3, the choke 15 is covered with an insulating cap 16.

In order to facilitate placement of the ferrite ring core choke 15 on the potential-isolating device, the straps 6, 8 are chamfered at their free or upper end faces, as indicated at reference numerals 7 and 10.

In order to indicate the position of the windings of the choke relative to the ferrite ring core, the strap 8 is wider than the straps 6 at the free or upper end face 24 thereof facing away from the insulating material plate 1.

The foregoing is a description corresponding in substance to German Application No. P 33 30 881.0, filed Aug. 26, 1983, the International priority of which is being claimed for the instant application and which is hereby made part of this application. Any material discrepancies between the foregoing specification and the aforementioned corresponding German application are to be resolved in favor of the latter.

I claim:

1. Mounting and current-compensated ferrite ring core choke, comprising an insulating material plate, and a potential-isolating device, said potential-isolating device including straps fastened upright on said insulating material plate, and a resilient ring interconnecting said straps, said straps having inner edges facing each other and outer edges, the ferrite ring core choke being slipped on said potential-isolating device with said outer edges of said straps resting resiliently against the ferrite ring core and windings on different sections of the ring core physically separated from each other.

2. Mounting and current-compensated ferrite ring core choke according to claim 1, wherein said insulating material plate has cutouts formed therein defining resilient bracket elements between said cutouts, said straps being connected to said resilient bracket elements.

3. Mounting and current-compensated ferrite ring core choke according to claim 2, wherein said insulating material plate, said straps and said ring are integral with each other.

4. Mounting and current-compensated ferrite ring core choke according to claim 1, wherein said straps are in the form of two co-planar straps interconnected by said resilient ring.

5. Mounting and current-compensated ferrite ring core choke according to claim 1, wherein said straps are in the form of at least three straps disposed equidistant from the longitudinal central axis of said potential-isolating device, said straps having inner edges being interconnected by said resilient ring.

6. Mounting and current-compensated ferrite ring core choke according to claim 1, wherein said outer edges of said straps define the outer periphery of said potential-isolating device and rest resiliently against opposite surfaces defining a hole formed in the ferrite ring core.

7. Mounting and current-compensated ferrite ring core choke according to claim 1, wherein said straps have end surfaces facing away from said insulating material plate, and one of said straps is wider than the other of said straps at least at said end surface thereof, for positioning the windings relative to the ferrite ring core.

* * * * *